US008750763B2

(12) United States Patent
Martinkovic et al.

(10) Patent No.: US 8,750,763 B2
(45) Date of Patent: Jun. 10, 2014

(54) CHARGE ROLLER FOR AN IMAGE FORMING APPARATUS USING HARD FILLER PARTICLES

(75) Inventors: Matthew Thomas Martinkovic, Lexington, KY (US); Benjamin John Goebel, Woodbury, MN (US)

(73) Assignee: Lexmark International, Inc., Lexington, KY (US)

( * ) Notice: Subject to any disclaimer, the term of this patent is extended or adjusted under 35 U.S.C. 154(b) by 178 days.

(21) Appl. No.: 13/352,391

(22) Filed: Jan. 18, 2012

(65) Prior Publication Data

US 2013/0170860 A1 Jul. 4, 2013

Related U.S. Application Data

(60) Provisional application No. 61/581,862, filed on Dec. 30, 2011.

(51) Int. Cl.
*G03G 15/02* (2006.01)

(52) U.S. Cl.
USPC ..... 399/176

(58) Field of Classification Search
USPC ..... 399/176
See application file for complete search history.

(56) References Cited

U.S. PATENT DOCUMENTS 5,751,801 A 5/1998 Murata et al.
6,647,231 B2 * 11/2003 Funabashi ..... 399/176
7,835,669 B2 * 11/2010 Furukawa et al. ..... 399/176
2004/0053151 A1 3/2004 Hashimoto et al.
2006/0165974 A1 7/2006 Ferrar et al.
2010/0247149 A1 9/2010 Hoshio
2010/0267537 A1 * 10/2010 Kashihara et al. ..... 492/18
2011/0044725 A1 * 2/2011 Mayuzumi et al. ..... 399/176
2011/0206405 A1 * 8/2011 Iikura ..... 399/90

OTHER PUBLICATIONS

International Search Report and Written Opinion of the International Searching Authority dated Feb. 26, 2013 for PCT Application No. PCT/US2012/071634.

Anonymous. Nylon-6,6. Polymer Processing. Feb. 21, 2001. [retrieved on Feb. 12, 2013 by the International Searching Authority]. Retrieved from the Internet: <URL: http://web.archive.org/web/20110221113303/http://www.polymerprocessing.com/polymers/PA66.html>.

Sorkin. The Phase Diagram of Carbon. Technion Israel Institute of Technology. Oct. 14, 2004. [retrieved on Feb. 12, 2013 by the International Searching Authority]. Retrieved from the Internet: <URL: http://web.archive.org/web/20041014031606/http://phycomp.technion.acil/~anastasy/teza/teza/node5.html>.

* cited by examiner

*Primary Examiner* — Walter L Lindsay, Jr.
*Assistant Examiner* — Frederick Wenderoth
(74) *Attorney, Agent, or Firm* — Justin M Tromp

(57) ABSTRACT

An image forming apparatus includes a charge roller with improved resistance to defects from prolonged periods of nonuse. The charge roller includes an outermost coating layer including a coating material and filler particles. The filler particles have an average particle size larger than an average thickness of the outermost coating layer in a portion without the filler particles. Furthermore, the filler particles are harder and have a higher glass transition temperature than the coating material.

21 Claims, 4 Drawing Sheets

CHARGE ROLLER FOR AN IMAGE FORMING APPARATUS USING HARD FILLER PARTICLES

CROSS REFERENCES TO RELATED APPLICATIONS

Pursuant to 35 U.S.C. §119, this application claims the benefit of the earlier filing date of Provisional Application Ser. No. 61/581,862, filed Dec. 30, 2011, entitled "A Charge Roller for an Image Forming Apparatus Using Hard Filler Particles," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure generally relates to imaging and, more particularly, to an imaging device having a charge roller with improved resistance to defects from prolonged periods of inactivity.

2. Description of the Related Art

Generally, there are two distinct types of charge rollers used in electrophotographic devices such as laser printers. The first type is a charge roller which includes a core material whose surface may be modified by ultraviolet irradiation or chemical treatment. The second type is a charge roller which includes a core material and one or more coating layers. These charge roll types can operate by means of DC type charging or AC plus DC type charging.

It is commonly known that a charge roller may generate defects in a printed image after prolonged static contact with a photoconductor drum, especially if the contact occurs at higher temperature and humidity such as during shipping and warehouse storage. These charge roller defects may be chemical or mechanical in nature and can result in print defects in a printed image of the electrophotographic device.

Chemical defects may be due to the migration or leaching of low molecular weight components of the charge roll core material which may attack the outer surface of the charge roller or the coating layer of the photoconductor drum. This chemical defect may be prevented by the addition of one or more coating layers to the surface of the charge roll core material, which functions as a barrier to prevent chemical migration from occurring.

Mechanical defects may be related to the formation of a dent or flat spot on the outer surface of the charge roller which may be due to the high contact pressure exerted between the charge roller and the photoconductor drum. The resulting print defect of this mechanical defect may be in the form of a repeating horizontal line in the printed image of the electrophotographic device. Furthermore, this mechanical defect may occur even to charge rollers applied with one or more coating layers.

Various separation devices have already been utilized to keep the charge rollers away from contact with the photoconductor drum during shipping or storage. This includes a shipping separator which prevents the charge roller and photoconductor drum from contact during shipping. However, this shipping separator fails to prevent contact of charge roller and photoconductor drum during long periods of electrophotographic device shutdown or power-off. Printers used in schools, for example, may be turned off for the entire summer. A mechanical retract mechanism may be utilized which would disengage the charge roller during power-off. However, this would entail an additional manufacturing and design cost.

A non-contact charge roller may be employed in the electrophotographic device. But this non-contact charge roller may be expensive to create and requires very tight tolerance control of the gap between charge roller and photoconductor drum. Further, this non-contact charge roller requires AC plus DC type charging, thus having a more expensive power supply cost than DC type charge rolls.

Based upon the foregoing, there is a need to provide a charge roller which may withstand relatively high contact pressure with the photoconductor drum even when exposed to relatively high temperature and humidity for an extended period of time. Furthermore, it is desired to have a charge roller that may be resistant to mechanical defects.

SUMMARY

Embodiments of the present disclosure overcome shortcomings of prior charge rolls and thereby satisfy a significant need for a charge roll having improved resistance to defects from prolonged periods of nonuse. According to example embodiments, the charge roller includes a cylindrical core having an outer surface, and an outermost coating layer covering the outer surface of the cylindrical core. The outermost coating layer includes a coating material and filler particles. The filler particles have an average particle size larger than an average thickness of the outermost coating layer in a portion or area without the filler particles. Furthermore, the filler particles are harder and have a higher glass transition temperature than the coating material. These hard and relatively large filler particles may absorb the high pressure applied by a photoconductor drum upon contact with the charge roller, and act as a bridge that prevents the pressure between the charge roll and the photoconductive drum from being absorbed by the coating material, thus making the charge roller more resistant to mechanical defects. In an example embodiment, the charge roller and the photoconductor drum may be included in a removable unit for an image forming device.

BRIEF DESCRIPTION OF THE DRAWINGS

The above-mentioned and other features and advantages of the various embodiments of the invention, and the manner of attaining them, will become more apparent and will be better understood by reference to the accompanying drawings, wherein.

DETAILED DESCRIPTION

Figure 1:
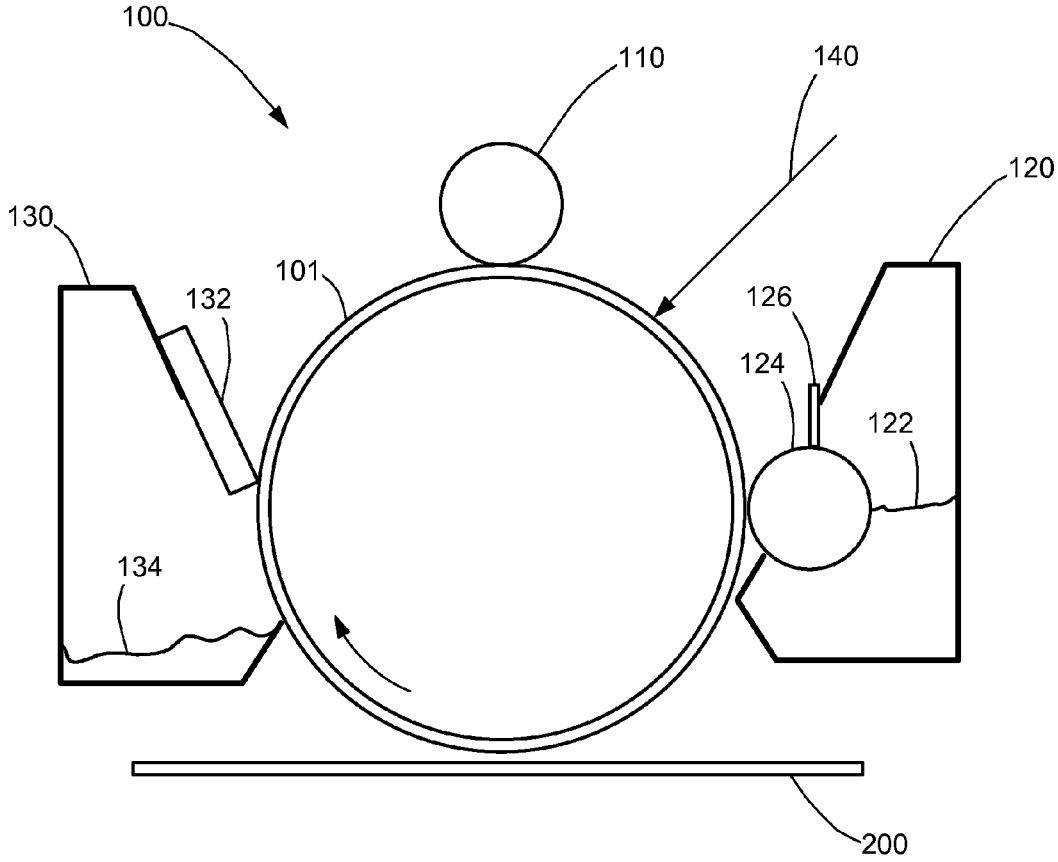
FIG. 1 is a schematic view of an image forming apparatus.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

Reference will now be made in detail to the example embodiment(s), as illustrated in the accompanying drawings. Whenever possible, the same reference numerals will be used throughout the drawings to refer to the same or like parts.

The present disclosure provides an image forming apparatus that employs a charge roller with improved defect resistance from prolonged periods of inactivity. The image forming apparatus of the present disclosure is an electrophotographic image forming apparatus. Suitable examples of the electrophotographic image forming apparatus may include a laser printer, a copying machine, a multifunctional peripheral and the like.

FIG. 1 is a schematic representation of an image forming apparatus 100, according to an embodiment of the present disclosure. The image forming apparatus 100 may comprise a photoconductor drum 101, a charge roller 110, a developer unit 120, and a cleaner unit 130. The charge roller 110 charges the surface of the photoconductor drum 101. The charged surface of the photoconductor drum 101 may then be irradiated by a laser light source 140 to form an electrostatic latent image on the photoconductor drum 101 corresponding to an image. A charged toner from the developer unit 120 is attached to the electrostatic latent image on the photoconductor drum 101. The image from the photoconductor drum 101 may be transferred directly to a recording medium, (e.g. paper 200) or may utilize an intermediate transfer belt (not shown) to transfer the image to the paper 200. A fusing unit (not shown) is used to fuse the toner image to the paper 200. A cleaner unit 130 may use a cleaning blade 132 to scrape off any residual toner still adhering to the photoconductor drum 101 after the image is transferred to the paper 200. A charge roller wiper (not shown) may be used to remove any remaining toner remnants on the charge roller 110. The cleaned surface of the photoconductor drum 101 may now be charged again, repeating the imaging and printing cycle. The waste toner 134 is held in a waste toner sump in the cleaning unit 130.

Depending upon the particular printer architecture, the charge roller 110 may be incorporated in a removable housing with photoconductor drum 101 that is separate from developer unit 120; a removable housing with photoconductor drum 101 and developer unit 120; and a removable housing with photoconductor drum 101, developer unit 120 and a toner bottle (not shown) which supplies toner to developer unit 120. Alternatively, charge roller 110 may be separately removable from image forming apparatus 100.

The developer unit 120 includes a developer roller 124 abuttingly coupled to the photoconductor drum 101. Further, the developer unit 120 includes a toner medium 122 including toner particles, a toner metering device 126 such as a doctor blade, a toner adder roller (not shown) for supplying toner medium to the developer roller 124, and one or more agitators (not shown) for breaking up formed clumps of toner with the developer unit 120. The toner medium 122 is stored in a sump provided in the developer unit 120. The developer roller 124 of the developer unit 120 is electrically charged and electrostatically attracts the toner particles of the toner medium 122 which are then formed into an even layer on the surface of the developer roller 124 by the toner metering device 126. The toner particles of the toner medium 122 are electrostatically attracted onto the surface of the photoconductor drum 101. Further, the developer roller 124 may undergo an angular rotation in a direction opposite to a direction of the angular rotation of photoconductor drum 101 for transferring the toner particles onto the surface of the photoconductor drum 101.

The photoconductor drum 101 includes a coating disposed onto the substrate. The coating includes a charge generation layer composed of materials that may photo-generate a charge onto the photoconductor drum 101 when contacted by a stream of photons, a charge transport layer composed of materials that may transport the generated charge, and optionally, a wear resistance layer that may provide insulation to the charge generation layer and the charge transport layer.

Figure 2:
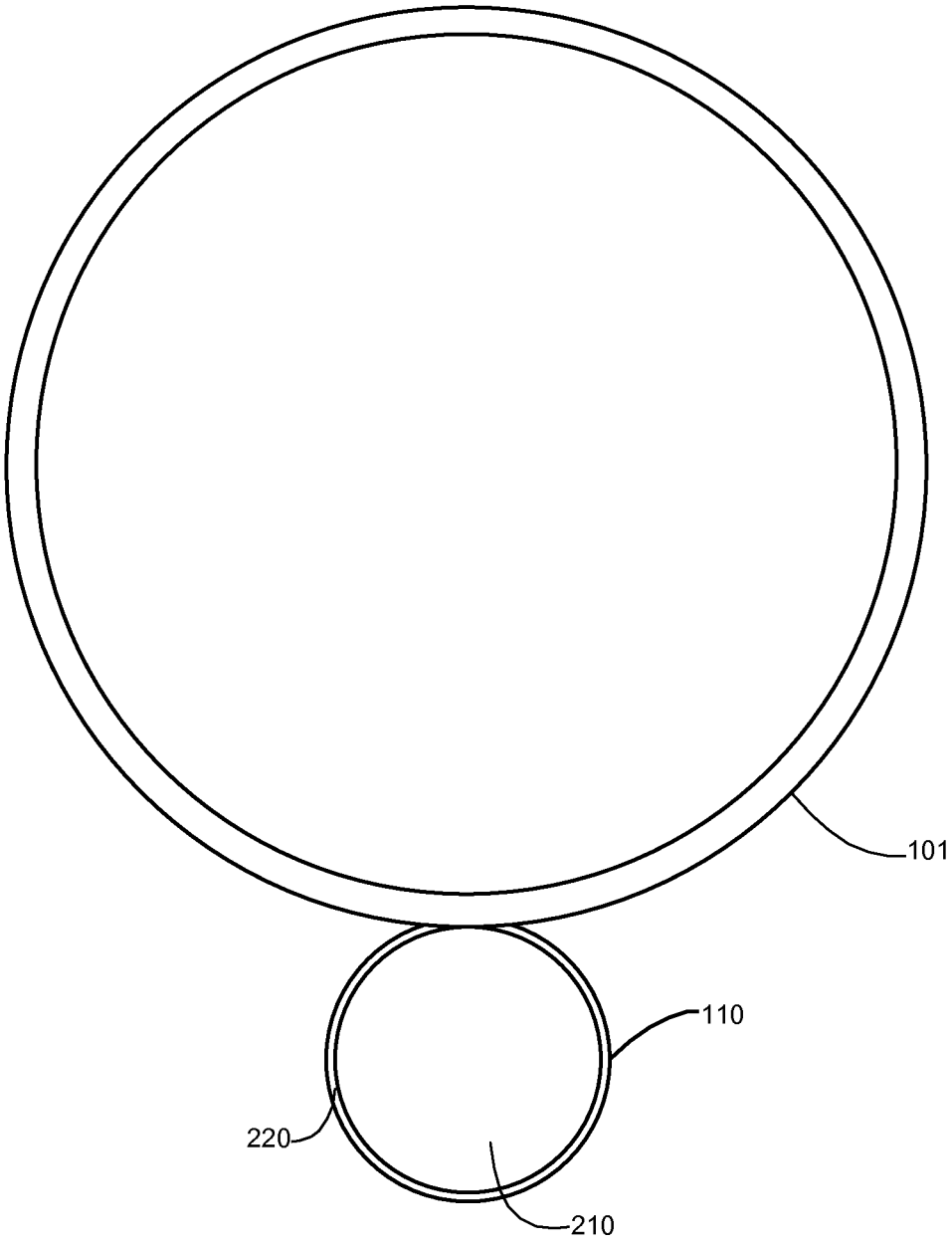
FIG. 2 is a schematic view of a charge roller coupled with a photoconductor drum in the image forming apparatus of FIG. 1.

FIG. 2 shows the charge roller 110 coupled to the photoconductor drum 101. It should be understood that in a working position, charge roller 110 contacts the photoconductor drum 101 to charge the photoconductor drum 101 to a predetermined voltage. In a storage position such as when the image forming apparatus 100 is turned off or operates in a power saving mode, the charge roller 110 may remain in contact with the photoconductor drum 101 or may be retracted from the photoconductor drum 101. In one example embodiment, the charge roller 110 may be in contact with the photoconductor drum 101 even during shipping or when stored for a long period of time. In some example embodiments, the charge roller 110 may be mechanically separated from photoconductor drum 101 during shipping or when stored for long periods of time.

The charge roller 110 may include a cylindrical core 210 having an outer surface. The cylindrical core 110 may, for example, comprise rubber materials selected from the group consisting of epichlorohydrin rubber (ECO), nitrile butadiene rubber (NBR), ethylene propylene diene monomer rubber (EPDM), silicone, and polyurethane rubber. In one example embodiment, the cylindrical core 210 may include one or more coating layers. In some example embodiment, the cylindrical core 210 may be applied with a surface treatment. Such surface treatment may include exposure to ultraviolet light or to chemicals.

Figure 3A:
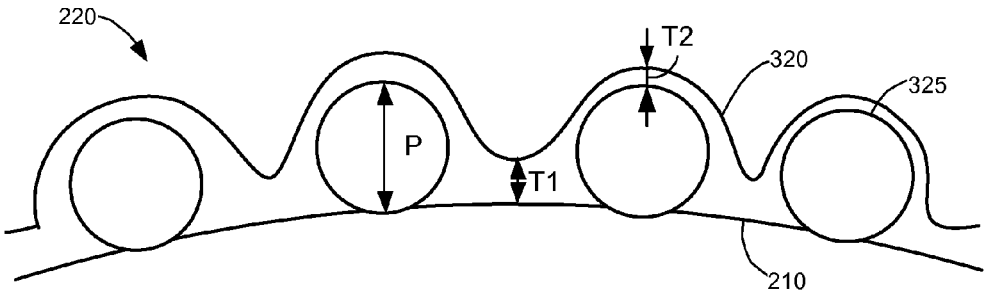
FIGS. 3A-3C are schematic views of an outermost coating layer of the charge roller of FIG. 2.
Figure 3B:
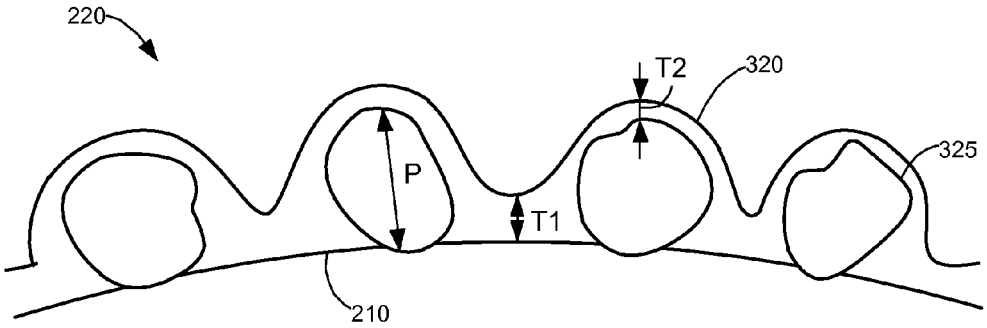
Figure 3C:
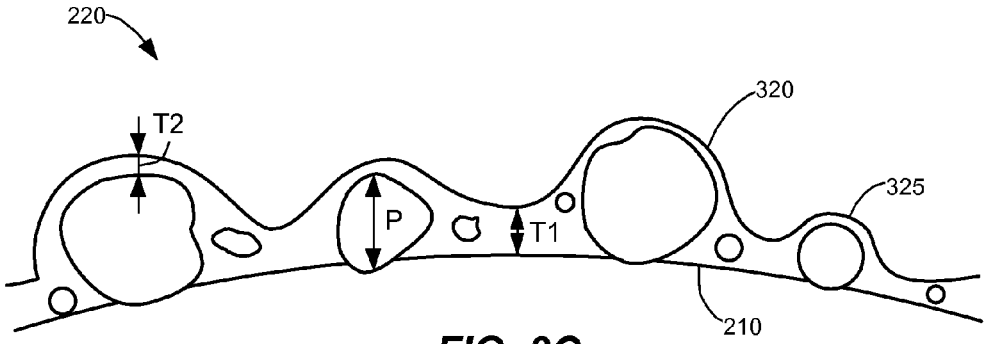

Furthermore, the charge roller 110 may include an outermost coating layer 220. With reference to FIGS. 3A-3C, the outermost coating layer 220 may include coating material 320 and filler particles 325. The coating material 320 may include, but is not limited to, one or more of polyamides, polyimides, polyurethanes, and acrylic materials. The filler particles 325 may include, but is not limited to, one or more of poly(methyl methacrylate), glass, silica, caprolactone, and polyamide. The filler particles 325 may be harder than the coating material 320 and may have a higher glass transition temperature than the coating material 320 to properly withstand the contact force between the photoconductor drum 101 and charge roller 110 and prevent damage to the outermost coating layer 220. Preferably, the filler particles 325 may have a hardness of about 80 Shore A to about 80 Shore D, and glass transition temperature of about 100° C. to about 350° C. In one example embodiment, the outermost coating layer 220 may include polyamide coating material 320 and poly(methyl methacrylate) filler particles 325. The polyamide coating material 320 may be cured or dried at a temperature below about 150° C. to provide soft coating material 320.

When installed within image forming apparatus 100, the filler particles 325 in the outermost coating layer 220 may contact the outer surface of the cylindrical core 210, either directly or through the coating material 320. These filler particles 325 may have large (mean) particle sizes P which extend beyond the nominal thickness of the outer coating material 320. The average particle size P of the filler particles 325 may be at least two times larger than the average thickness T1 of the outermost coating layer 220 in a portion without the large filler particles 325. In one example embodiment, the filler particles 325 may have an average particle size P between about 15 μm and about 20 μm and the portion of the outermost coating layer 220 without the large filler particles 325 may have an average thickness T1 of about 5 μm to about 10 μm. In another example embodiment, the filler particles 325 may have an average particle size P between about 15 μm and about 30 μm, and the portion of the outermost coating layer 220 without the large filler particles 325 may have an average thickness T1 of about 7 μm to about 10 μm. Furthermore, the thickness T2 of the coating material 320 covering the large filler particles 325 may be thinner than the thickness T1 of the outermost coating layer 220 without the large filler particles 325.

The filler particles 325 may have regular shapes, such as spherical shapes, irregular shapes, or both. Filler particles may be solid or amorphous. Furthermore, the filler particles 325 may have substantially uniform or non-uniform particle sizes P. FIG. 3A shows a schematic representation of the outermost coating layer 220 which includes filler particles 325 with regular spherical shapes and substantially uniform particle size P. FIG. 3B shows a schematic representation of the outermost coating layer 220 which includes filler particles 325 with irregular shapes and substantially uniform particle size P. The outermost coating layer 220 may include a combination of filler particles 325 with regular spherical shapes, irregular shapes, and non-uniform particle sizes as shown in FIG. 3C. It is to be understood that in some example embodiments, the filler particles 325 in the outermost coating layer 220 may vary in size, size distribution, and shape. Furthermore, the filler particles 325 may vary in material composition, porosity, and loading amount in the outermost coating layer 220.

The inclusion of filler particles 325 in the outermost coating layer 220 of the charge roller 110 increases the surface roughness of the charge roller 110. Without the filler particles 325 in the outermost coating layer 220 of the charge roller 110, the charge roller surface may have an average roughness Ra of less than about 0.4 μm, a ten point average roughness Rz of less than about 5 μm, and a peak count Rpc of less than about 15/cm measured with upper and lower "height" threshold conditions $C_1$ and $C_2$ equal to 1 μm. Upon loading of the filler particles 325 in the outermost coating layer 220 of the charge roller 110, the charge roller surface may have an average surface roughness Ra of greater than or equal to about 1 μm, a ten point average roughness Rz of greater than or equal to about 5 μm, and a peak count Rpc of greater than or equal to about 10. In particular, the charge roller surface may then have an average roughness Ra of about 1 μm to about 5 μm, and more particularly between about 1.3 μm and about 3.3 μm; a ten point average roughness Rz of about 5 μm to about 30 μm, and more particularly between about 10 μm and about 18 μm; and peak count Rpc of about 50/cm to about 100/cm, and more particularly between about 55/cm and 95/cm measured with threshold conditions of $C_1$ and $C_2$ equal to 1 μm. Such values for Ra, Rz and Rpc may be measured using a contact profilometer incorporating a stylus. The stylus has a radius of 5 μm and maintains contact with the surface to be characterized at a force of 0.8 mN. The stylus is dragged across the surface using a cutoff length of 0.8 mm. Furthermore, the increase of surface roughness of the outermost coating layer 220, is seen to improve the charging efficiency of the charge roller 110.

Additionally, the inclusion of relatively hard, relatively large filler particles 325 in the outermost coating layer 220 prevents the occurrence of mechanical defects in the charge roller surface. These hard and large filler particles 325 may absorb the high pressure applied by the photoconductor drum 101 upon contact with the charge roller 110, and act as a bridge or separator that prevents the pressure from being absorbed by the coating material 320, thus making the charge roller 110 more resistant to mechanical defects due to pressure from prolonged periods of nonuse.

Figure 4:
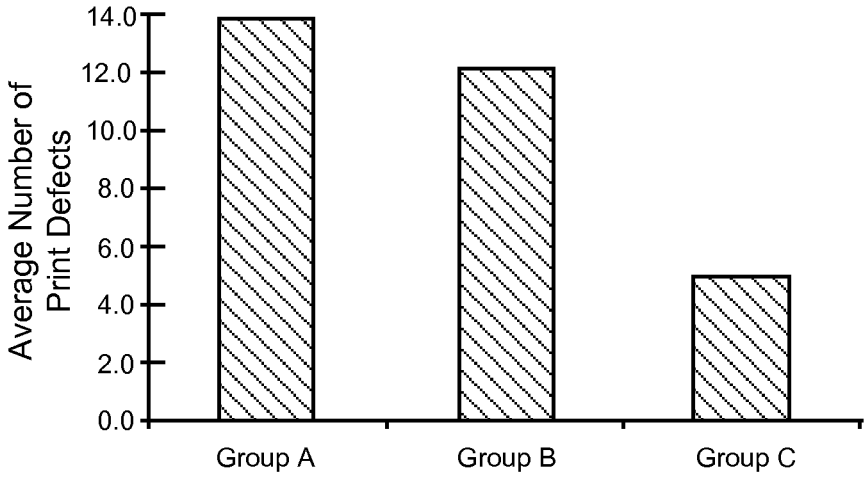
FIG. 4 is a graphical illustration of test results of a ship/store defect evaluation conducted on a toner cartridge of the image forming apparatus of FIG. 1.

FIG. 4 graphically illustrates test results of a ship/store defect evaluation conducted on three groups of charge rolls A, B, and C having different configuration of filler particles in the outermost coating layer. Charge rollers A had outermost coating layer 220 without filler particles. Charge rollers B had outermost coating layer 220 which included filler particles 325 having an average particle size of about 6 μm to about 8 μm. Charge rollers C had outermost coating layer 220 which included relatively large filler particles 325 having an average particle size of greater than or equal to about 15 μm.

Each of the charge rollers A, B, and C were coupled with corresponding photoconductor drums in an imaging unit or like arrangement. Both the charge rollers and corresponding photoconductor drums were marked to indicate a contact location between the two. The assemblies were stored at a temperature of about 43° C. and relative humidity of about 80% for about 18 days. After storage, the toner cartridges were then placed into an imaging device for print testing. Each printed sheet was examined for defects. Print defects were determined to be caused by the corresponding charge roll, photoconductive drum or both by comparing the frequency of the print defects on the printed page with the circumferences of the charge rolls and photoconductive drums. FIG. 4 shows the average number of print defects formed on the printed image of the imaging device incorporating the evaluated charge rollers A, B, and C. As illustrated in FIG. 4, charge rollers C having the outermost coating layer 220 with the larger filler particles had the least average number of print defects.

The foregoing description of several methods and embodiments has been presented for purposes of illustration. It is not intended to be exhaustive or to limit the disclosure to the precise acts and/or forms disclosed, and obviously many modifications and variations are possible in light of the above teaching. It is intended that the scope of the invention be defined by the claims appended hereto.

What is claimed is:

1. A charge roller of an image forming apparatus, comprising:

a cylindrical core having an outer surface; and an outermost coating layer covering the outer surface of the cylindrical core, the outermost coating layer includes a coating material and filler particles, wherein the filler particles have an average particle size larger than an average thickness of the outermost coating layer in a portion without the filler particles and the filler particles have a hardness of between about 80 Shore A and about 80 Shore D.

2. The charge roller of claim 1, wherein the coating material holds the filler particles in the coating layer relatively immobile and at least some of the filler particles directly contact the outer surface of the cylindrical core.

3. The charge roller of claim 1, wherein the particle sizes of the filler particles are at least two times larger than the average thickness of the outermost coating layer in the portion without the filler particles.

4. The charge roller of claim 1, wherein the filler particles have an average particle size greater than or equal to about 15 μm.

5. The charge roller of claim 1, wherein the portion of the outermost coating layer without the filler particles has an average thickness of about 5 μm to about 10 μm.

6. The charge roller of claim 1, wherein the filler particles have an average particle size greater than or equal to about 15 μm and less than about 30 μm, and the outermost coating layer in the portion without the filler particles have average thickness of about 7 μm to about 10 μm.

7. The charge roller of claim 1, wherein the outermost coating layer has an average surface roughness Ra in a range of about 1 μm to about 5 μm, a ten point average roughness Rz in a range of about 5 μm to about 30 μm, and a peak count Rpc in a range of about 50/cm to about 100/cm.

8. The charge roller of claim 1, wherein the filler particles have an irregular shape.

9. The charge roller of claim 1, wherein the filler particles have a regular spherical shape.

10. The charge roller of claim 1, wherein the filler particles have a higher glass transition temperature than the coating material.

11. The charge roller of claim 1, wherein the filler particles comprise one or more of poly(methyl methacrylate), glass, silica, caprolactone, and polyamide particles.

12. The charge roller of claim 1, wherein the coating material comprises polyamides, polyimides, polyurethane or acrylic material.

13. The charge roller of claim 1, wherein the outermost coating layer includes a polyamide coating material and poly (methyl methacrylate) filler particles.

14. A removable unit for an image forming device, comprising:

a photoconductor having a photoconductive surface; and a charge roller for charging the photoconductive surface of the photoconductor, the charge roller including:

a cylindrical core having an outer surface, and an outermost coating layer covering the outer surface of the cylindrical core, the outermost coating layer includes a coating material and filler particles, wherein the coating material holds the filler particles in the coating layer relatively immobile, and wherein at least some of the filler particles directly contact the outer surface of the cylindrical core and have particle sizes larger than an average thickness of the outermost coating layer in a portion without the filler particles.

15. The image forming apparatus of claim 14, wherein the particle sizes of the filler particles are at least about two times larger than the average thickness of the outermost coating layer in the portion without the filler particles.

16. The image forming apparatus of claim 14, wherein the filler particles have an average particle size greater than or equal to about 15 μm and less than about 30 μm, and the outermost coating layer in the portion without the filler particles have average thickness of about 7 μm to about 10 μm.

17. The charge roller of claim 14, wherein the filler particles have a hardness of between about 80 Shore A and about 80 Shore D.

18. The charge roller of claim 14, wherein the filler particles have a higher glass transition temperature than the coating material.

19. The image forming apparatus of claim 14, wherein the outermost coating layer includes a polyamide coating material and poly(methyl methacrylate) filler particles.

20. The image forming apparatus of claim 14, wherein the filler particles contact the photoconductive surface of the photoconductor through the coating material.

21. A charge roller for an image forming apparatus, comprising:

a cylindrical core having an outer surface, and an outermost coating layer covering the outer surface of the cylindrical core, the outermost coating layer includes a coating material and filler particles, wherein the coating material holds the filler particles in the coating layer relatively immobile, and wherein at least some of the filler particles directly contact the outer surface of the cylindrical core and have particle sizes larger than an average thickness of the outermost coating layer in a portion without the filler particles.

* * * * *